US008061131B2

(12) United States Patent
Kuhlbach

(10) Patent No.: US 8,061,131 B2
(45) Date of Patent: Nov. 22, 2011

(54) CYLINDER HEAD FOR AN INTERNAL COMBUSTION ENGINE

(75) Inventor: Kai Sebastian Kuhlbach, Bergisch Gladbach (DE)

(73) Assignee: Ford Global Technologies LLC, Dearborn, MI (US)

( * ) Notice: Subject to any disclaimer, the term of this patent is extended or adjusted under 35 U.S.C. 154(b) by 202 days.

(21) Appl. No.: 12/565,948

(22) Filed: Sep. 24, 2009

(65) Prior Publication Data

US 2010/0083920 A1 Apr. 8, 2010

(30) Foreign Application Priority Data

Oct. 2, 2008 (EP) ..... 08105481

(51) Int. Cl.
*F02F 1/00* (2006.01)

(52) U.S. Cl. ..... 60/323; 123/193.5

(58) Field of Classification Search ..... 60/313–323; 123/41.82 R, 193.5

See application file for complete search history.

(56) References Cited

U.S. PATENT DOCUMENTS

| | | | | |
|---|---|---|---|---|
| 4,484,440 | A * | 11/1984 | Oki et al. | 60/276 |
| 5,095,704 | A | 3/1992 | Nagura et al. | |
| 5,816,045 | A * | 10/1998 | Blocker et al. | 60/323 |
| 6,122,911 | A * | 9/2000 | Maeda et al. | 60/323 |
| 6,513,506 | B1 | 2/2003 | Ito et al. | |
| 6,672,296 | B2 | 1/2004 | Ito et al. | |
| 7,520,127 | B2 * | 4/2009 | Ashida et al. | 60/323 |
| 2002/0026909 | A1 | 3/2002 | Akiwa et al. | |
| 2003/0098005 | A1 | 5/2003 | Ito et al. | |
| 2008/0308050 | A1 * | 12/2008 | Kuhlbach et al. | 123/41.82 R |

FOREIGN PATENT DOCUMENTS

| | | | |
|---|---|---|---|
| DE | 2508952 | C2 | 12/1982 |
| EP | 1722090 | A2 | 11/2006 |
| FR | 889855 | A | 1/1944 |

OTHER PUBLICATIONS

Search Report for EP 08105481, dated Apr. 29, 2009.

* cited by examiner

*Primary Examiner* — M. McMahon

(74) *Attorney, Agent, or Firm* — Julia Voutyras; Brooks Kushman P.C.

(57) ABSTRACT

A cylinder head adapted to be mounted to a cylinder block of an internal combustion engine has a cooling jacket at least partially integrated in the cylinder head. The engine has two groups of cylinders: inside cylinders and outside cylinders. Each cylinder has at least one exhaust port, each leading to an individual duct. Individual ducts of outside cylinders converge to form an outside combined duct. In a four-cylinder, individual ducts of inside cylinders converge to form an inside combined duct with the inside combined duct remaining separated from the outside combined duct by the cooling jacket. The inside combined duct is farther away from the mounting surface of the cylinder head to the cylinder block than the outside combined duct. The cooling jacket includes: upper, middle, and lower cooling jackets and connectors between the upper and lower cooling jackets.

9 Claims, 7 Drawing Sheets

CYLINDER HEAD FOR AN INTERNAL COMBUSTION ENGINE

CROSS-REFERENCE TO RELATED APPLICATIONS

This application claims foreign priority benefits under 35 U.S.C. §119(a)-(d) to EP 08105481.9 filed Oct. 2, 2008, which is hereby incorporated by reference in its entirety.

BACKGROUND

1. Technical Field

The disclosure relates to a cylinder head for an internal combustion engine with integrated exhaust manifolds.

2. Background Art

Internal combustion engines have a cylinder block with a cylinder head mounted thereon. The block and cylinder head having mounting surfaces with a cylinder head gasket in between and the two are coupled together by threaded bolts. The cylinder block has multiple cylinders each having a piston which reciprocates therein. A combustion chamber is delimited by the cylinder head, cylinder walls, and the piston.

Intake ports through which the fresh mixture is supplied to the combustion chamber and exhaust ports through with the exhaust gases are removed from the combustion chamber are provided in the cylinder head. A valvetrain actuates the intake and exhaust valves which cover the intake and exhaust ports, respectively. Each cylinder has at least one each of an intake and an exhaust valve. Many engines have multiple intake valves and multiple exhaust valves per cylinder to provide additional cross-sectional area through which gases can flow to improve scavenging.

The exhaust exiting the engine may be fed to a turbine of an exhaust turbocharger and/or exhaust gas aftertreatment devices. To ensure that the exhaust gases entering the turbocharger and/or aftertreatment devices are hot, to achieve a rapid lightoff of the aftertreatment devices, and to reduce turbocharger lag, it is desirable to mount the turbocharger and/or aftertreatment devices close to the location that the exhaust gases exit the combustion chamber.

A cylinder head with an integrated exhaust manifold and with liquid cooling is disclosed, for example, in EP 1 722 090 A2 in which a compact cylinder head is provided. The cooling of the cylinder head described in EP 1 722 090 A2 proved to be inadequate in practice due to thermal loading in the region where the exhaust gas ducts converge into the overall exhaust duct. To prevent melting, the fuel/air mixture is enriched whenever high exhaust gas temperatures are expected, which results in more fuel being injected than can by burned by the air quantity provided, thus a penalty in fuel economy.

SUMMARY

To keep the distance to the turbocharger and/or aftertreatment devices as short as possible, exhaust gas ducts are converged within the cylinder head prior to exiting the cylinder head. The cylinders form two groups. In a three-cylinder engine, two outside cylinders converge prior to exiting the cylinder head to form a group and the inside cylinder exits separately. In a four-cylinder engine, two outside cylinders converge prior to exiting the cylinder head to form a first group. Two inside cylinders converge prior to exiting the cylinder head with the ducts from the inside and outside cylinders remaining separated through the cylinder head to form a second group.

A cylinder head for a four-cylinder engine, according to an embodiment of the present disclosure, has two exhaust ports per cylinder, a pair of individual ducts per cylinder coupled to the exhaust ports, a paired duct coupled to each pair of individual ducts, an outside combined duct coupled to paired ducts of outside cylinders, and an inside combined duct coupled to paired ducts of outside cylinders. The outside combined duct is separated from the inside combined duct. The cylinder head is adapted to mount to a cylinder block at a mounting surface. The cylinder head also has a cooling jacket comprising: a lower cooling jacket disposed between the mounting surface of the cylinder head and the outside combined duct, a middle cooling jacket disposed between the outside combined duct and the inside combined duct, and an upper cooling jacket disposed between a surface away from the mounting surface and the inside combined duct. In one embodiment, connectors are provided between the upper and lower cooling jackets.

Alternatively, a cylinder head for a four-cylinder engine, has one exhaust port per cylinder, an individual duct coupled to the exhaust port, an outside combined duct coupled to individual ducts of outside cylinders, and an inside combined duct coupled to individual ducts of outside cylinders. The outside combined duct is separated from the inside combined duct with a middle cooling jacket in between the two combined ducts. The two ducts exiting the cylinder head can be coupled to two exhaust turbochargers arranged in parallel or a double-entry turbocharger.

By reducing the length of the exhaust gas ducts due to integrating them into the cylinder head, the exhaust gas volume upstream of an exhaust turbine is reduced, which reduces turbocharger lag. Also, the shorter exhaust gas ducts lead to lower thermal inertia of the exhaust system so that exhaust gas temperature at the turbine inlet is increased and the enthalpy of the exhaust gases at the inlet of the turbine is higher. Also, the enthalpy of exhaust gases at exhaust aftertreatment devices is increased, which, in some situations, presents an advantage in maintaining the temperature in the device within a high conversion efficiency range. Furthermore, the overall packaging of the engine is aided by shortened exhaust gas duct length.

A cylinder head with integrated exhaust manifolds is subject to higher thermal load than a conventional cylinder head equipped with an outside manifold particularly in the areas where ducts converge. Thus, such a configuration has increased cooling requirements. The energy released during combustion is partially converted to work at the piston and some energy leaves the engine as thermal energy: energy transfer to the engine coolant and hot exhaust gases leaving the engine. The hot gases exiting the combustion chamber heat the surfaces they contact. To keep the thermal load on the cylinder head within limits, a cooling jacket is provided in the cylinder head through which liquid coolant flow is forced. The coolant is conveyed by a pump arranged in a cooling circuit. The heat transferred to the coolant is then discharged in a heat exchanger (commonly called a radiator). The potential overheating disadvantage is overcome, according to an embodiment of the present disclosure, by wrapping a cooling jacket over exhaust ducts for a longer length than in conventional cylinder heads in which the exhaust ducts are combined in an exhaust manifold.

In a four-cylinder engine, each of the combined ducts receives exhaust gases separated by about 360 crank degrees of revolution. This helps to overcome overheating concerns compared to a cylinder head in which the ducts of all four cylinders are integrated into a single duct within the cylinder head, in which the single combined duct receives exhaust gases about every 180 degrees.

In gasoline engines, it is known, at high torque levels, to enrich the fuel/air mixture to lower exhaust gas temperature. By integrating the exhaust manifold in the cylinder head according to an embodiment of the disclosure, it is possible to reduce, or possibly dispense with, enrichment. This improves fuel economy and reduces emissions from the engine. Furthermore, other measures that are undertaken to avoid overheating the cylinder head may no longer be necessary according to an embodiment of the disclosure.

The cylinder head according to the disclosure is suitable particularly for supercharged internal combustion engines which require efficient and optimized cooling because of higher exhaust gas temperatures due to compression heating of the charge and due to burning more fuel and air in the cylinder.

Because the exhaust gas ducts are shortened, according to an embodiment of the disclosure, a potential issue is that dynamic wave processes in the cylinders can interact with each other and impede flow. However, according to an embodiment of the disclosure, the outside cylinders are grouped together and the inside cylinders are grouped together. In four-cylinder engines, the firing order (1-4-3-2) is such that an inside cylinder follows the firing of an outside cylinder and vice versa. Thus, about 360 degrees elapses between firings in regards to grouped cylinders. Thus, the potential disadvantage of the dynamic pressure waves of grouped cylinder impacting gas flow through cylinders is largely overcome by the selection of cylinder groups. Moreover, convergence of the exhaust ducts into combined exhaust ducts in steps contributes to a more compact type of construction of the cylinder head and therefore, in particular, to a weight reduction and more effective packaging.

An internal combustion engine may also have two cylinder heads according to the disclosure, for example when the cylinders are in two cylinder banks. Embodiments can also be implemented in which not the exhaust gas ducts of all the cylinders of a cylinder head are converged into two combined ducts, but, instead, only some of the cylinders arranged in the cylinder head are grouped in the manner according to the disclosure.

An embodiment according to the present invention has the inside combined duct and outside combined duct offset with respect to each other along the longitudinal axis of the cylinder head. The offset allows a compact construction while retaining sufficient strength of the material between the ducts. Furthermore, by providing an offset, the area between the two ducts remains cooler.

DETAILED DESCRIPTION

As those of ordinary skill in the art will understand, various features of the embodiments illustrated and described with reference to any one of the Figures may be combined with features illustrated in one or more other Figures to produce alternative embodiments that are not explicitly illustrated or described. The combinations of features illustrated provide representative embodiments for typical applications. However, various combinations and modifications of the features consistent with the teachings of the present disclosure may be desired for particular applications or implementations. Those of ordinary skill in the art may recognize similar applications or implementations consistent with the present disclosure, e.g., ones in which components are arranged in a slightly different order than shown in the embodiments in the Figures. Those of ordinary skill in the art will recognize that the teachings of the present disclosure may be applied to other applications or implementations.

Figure 1:
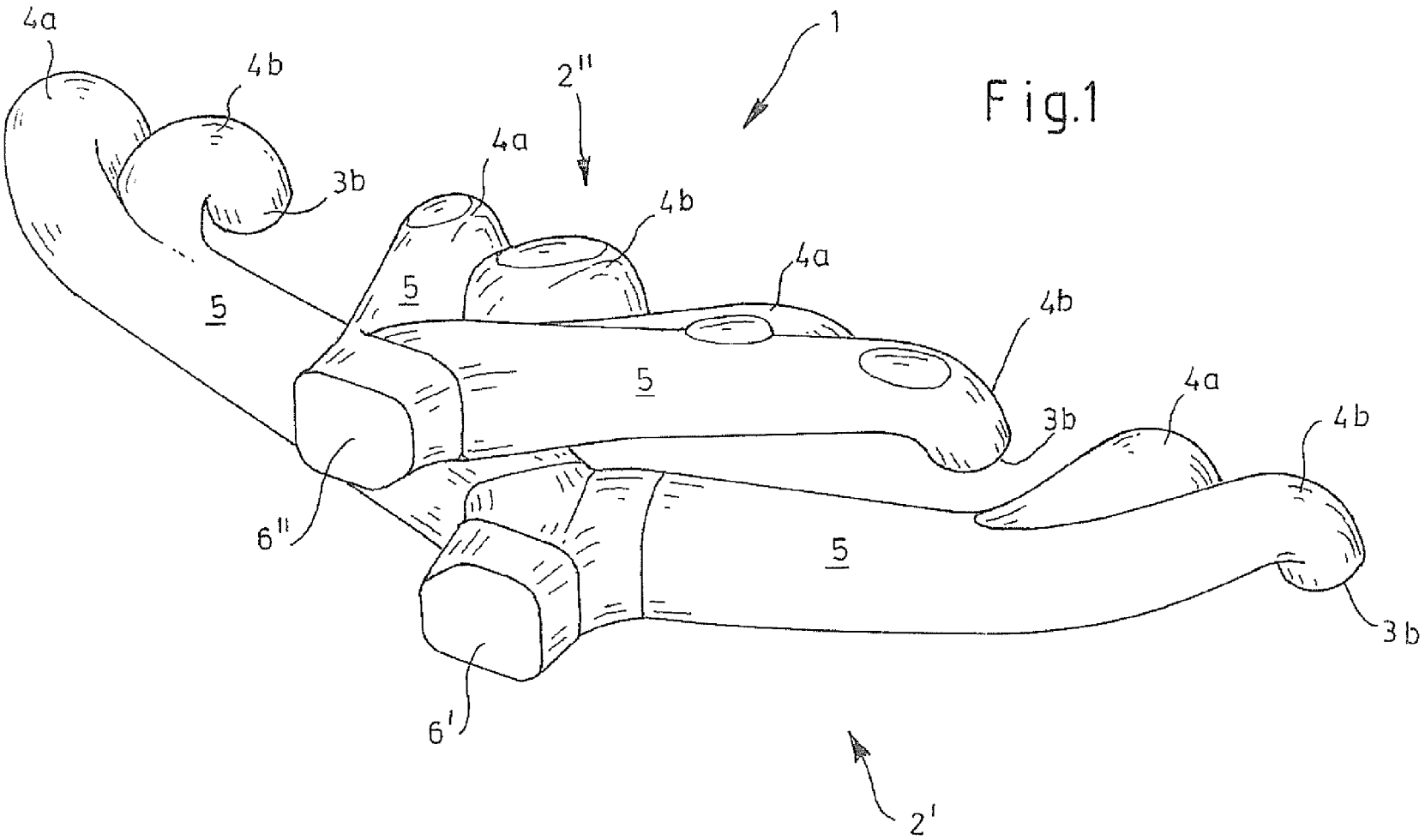
FIG. 1 is a perspective view of a sand core of exhaust gas ducts integrated in the cylinder head according to an embodiment of the disclosure.

FIG. 1 shows a perspective view of a sand core 1 for forming the exhaust gas ducts 4*a*, 4*b*, 5, 6', 6" adapted to be integrated in a cylinder head according to an embodiment of the disclosure. The example in FIG. 1 cylinder head is a four-cylinder, in-line engine in which the cylinders are arranged along a longitudinal axis of the cylinder head. Each cylinder has two exhaust ports 3*a*, 3*b* and individual exhaust duct 4*a*, 4*b* coupled to each exhaust port 3*a*, 3*b*. The cylinders form two groups: one group including outside cylinders and the other group including inside cylinders. Each pair of individual exhaust ducts 4*a*, 4*b* converge to form a paired exhaust duct 5. The paired exhaust ducts 5 of inside cylinders converge to form an inside combined duct 6". Similarly, the paired exhaust ducts 5 of outside cylinders converge to form an outside combined duct 6'. The ducts associated with inside cylinders remain separated from ducts associated with outside cylinders within the cylinder head. The ducts associated with inside cylinders form an inside integrated manifold 2" and the ducts associated with outside cylinders form an outside integrated manifold 2'. The inside manifold integrated manifold 2" is separated from the outside manifold integrated manifold 2'.

Figure 2:
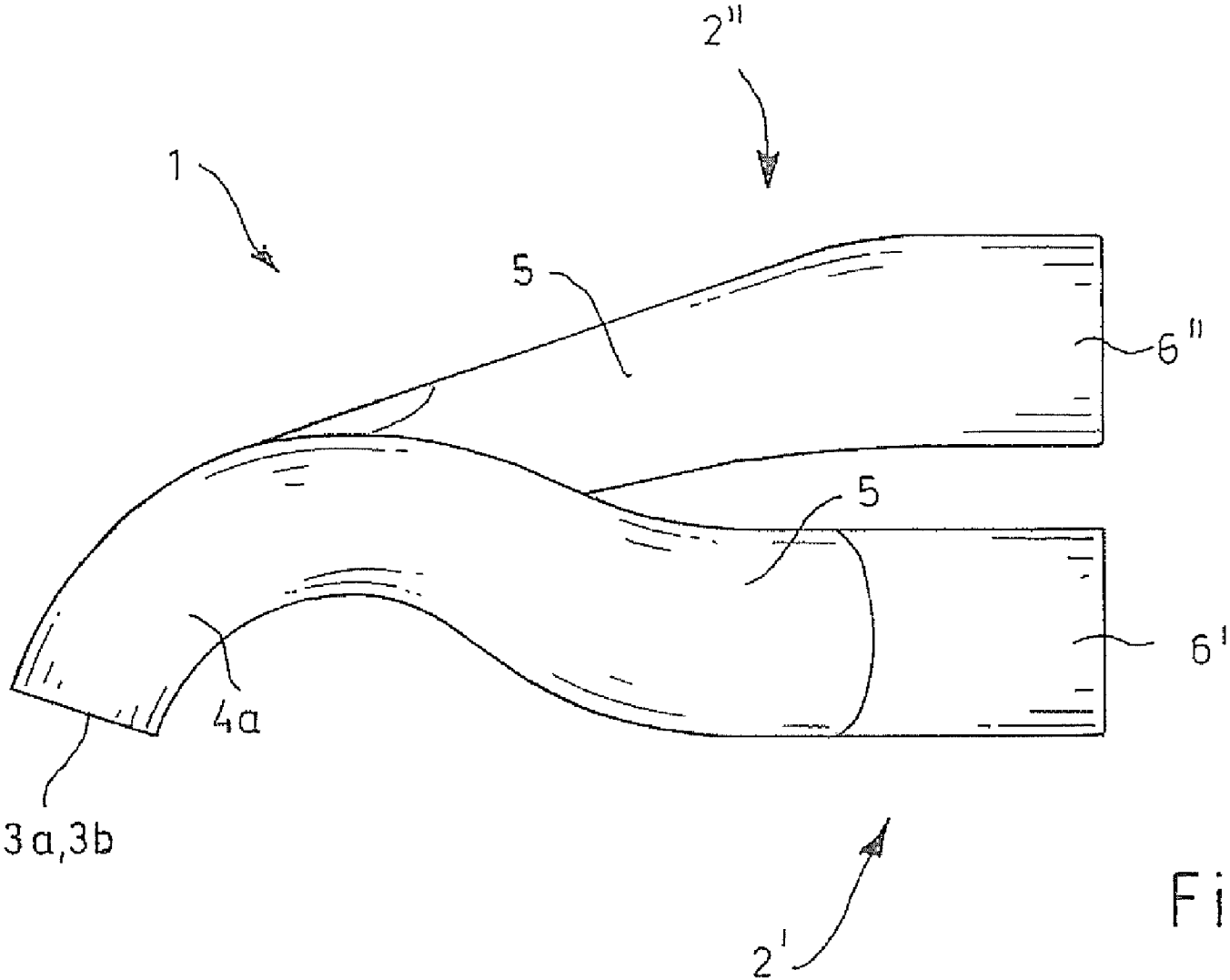
FIG. 2 is a side of view of the sand core illustrated in FIG. 1.

Sand cores are shown in FIG. 1-6. The ducts, as described in regards to FIGS. 1 and 2 are formed of sand. However, in a cylinder head, shown in FIG. 7, the sand is removed and the ducts are passageways defined in the cylinder head. For convenience, ducts 3*a*, 3*b*, 4*a*, 4*b*, 5, 6', 6" are described as ducts even though in FIGS. 1 and 2, they are illustrated by the sand core. Similarly, the sand core for cooling passages are shown in FIGS. 3-6, but referred to as passages for convenience; and, again with the understanding that in the cylinder head, the sand is removed and the cooling passages are defined in the cylinder head.

In a three-cylinder engine, there is only one inside cylinder. Thus, there is no inside combined duct 6". Instead the paired duct 5 exits the cylinder head directly, in an engine with two or more exhaust ports. If the engine has a single exhaust valve, the individual duct 4*a* exits the cylinder head directly.

In the exhaust system in FIG. 1, the combined ducts 6', 6" are offset from each other along the longitudinal axis of the cylinder head. The inside combined duct 6" of the second integrated exhaust manifold 2" is further away from the mounting surface than the second integrated exhaust manifold 2'. The mounting surface of the cylinder head is the surface proximate the engine block as mounted on the engine block; a cylinder head is shown in conjunction with FIG. 7.

FIG. 2 shows the sand core 1 illustrated in FIG. 1 in a side view in the direction of the longitudinal axis of the cylinder head. The same reference symbols as in FIG. 1 are used for the same components.

Figure 3:
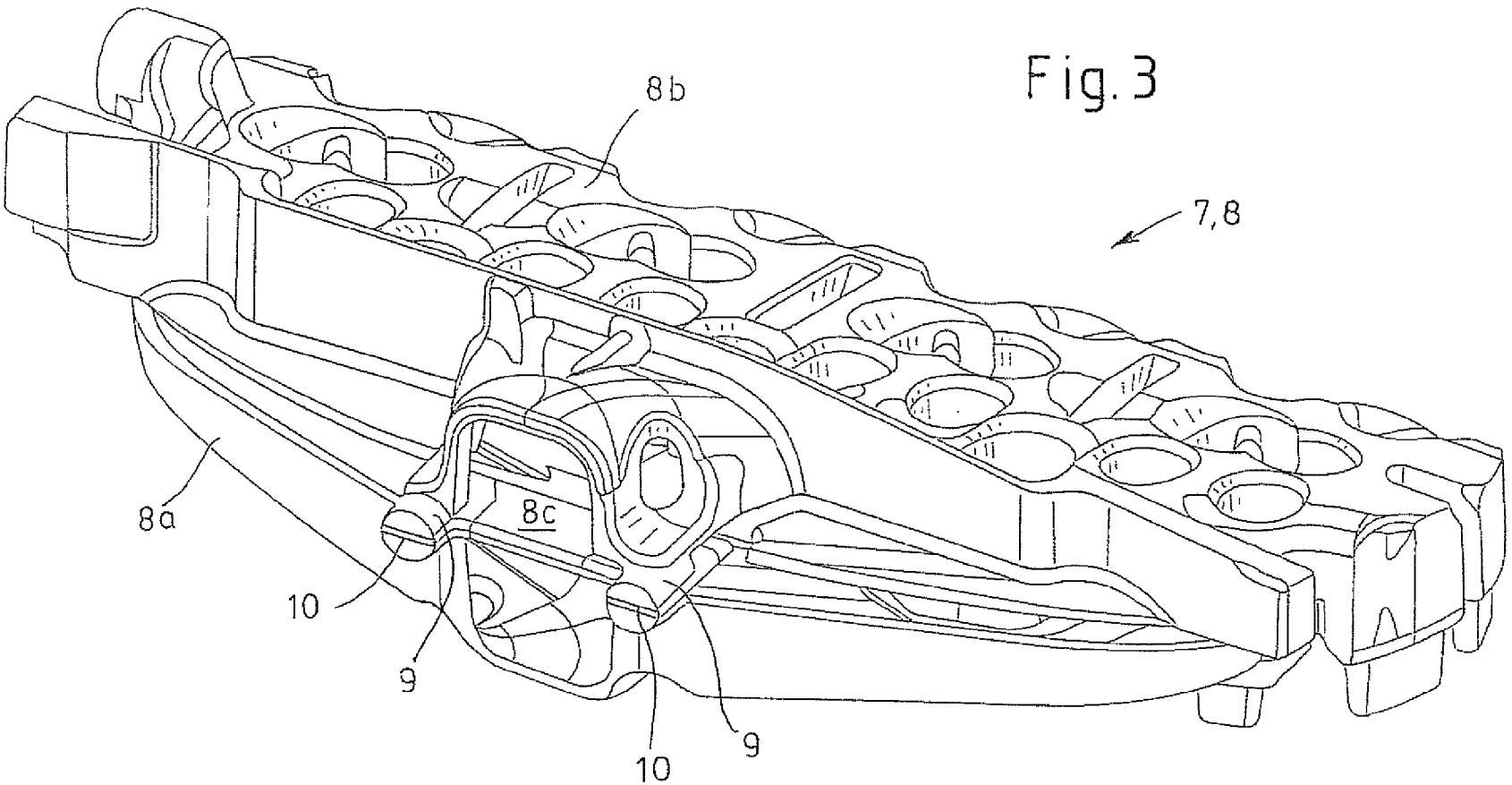
FIG. 3 is a perspective view of the sand core of the cooling jacket integrated in the cylinder head according to an embodiment of the disclosure.

FIG. 3 shows a perspective illustration of the sand core 7 for forming the cooling jacket 8 integrated in the cylinder head according to a first embodiment.

The cooling jacket 8 comprises: a lower cooling jacket 8*a*, which is arranged between the exhaust gas ducts and a mounting end face (not shown in FIG. 3), of the cylinder head; an upper cooling jacket 8*b*, which is arranged on that side of the exhaust gas ducts 5 which lies opposite the lower cooling jacket 8*a*; and a middle cooling jacket 8*c* which is arranged between the overall exhaust gas ducts 6', 6", bends inwardly and consequently follows the run of the second integrated exhaust manifold (see also FIG. 2).

In an outer wall of the cylinder head (shown in FIG. 7), out of which the overall exhaust gas ducts 6', 6" emerge, two connectors 9 are provided which connect the lower cooling jacket 8*a* to the upper cooling jacket 8*b* and serve as a passage for coolant. The two connectors 9 are arranged on opposite sides of the overall exhaust gas ducts 6', 6" and are themselves connected to one another via the middle cooling jacket 8*c*.

The lower and the upper cooling jackets 8*a*, 8*b* are not connected to one another over the entire region of the outer wall, but only over a portion of the outer wall, specifically adjacent to the overall exhaust gas ducts 6', 6". The two connectors 9 are arranged adjacent to the region in which the cylinder head is subjected to particularly high thermal load.

Figure 5:
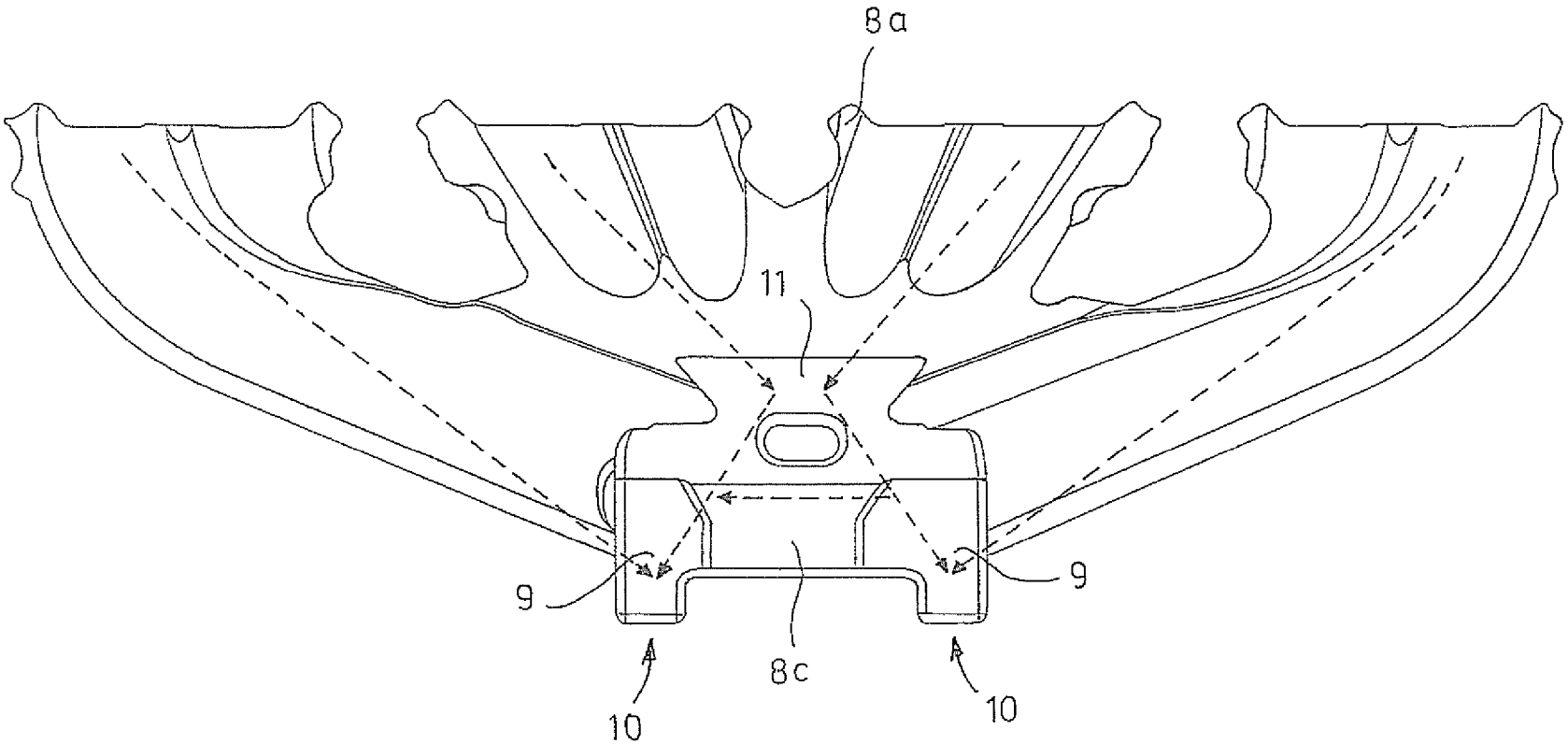
FIG. 5 is a top of view of a portion of the sand core illustrated in FIG. 3.

The longitudinal flows in the direction of the longitudinal axis of the cylinder head, which occur in the upper, lower and middle cooling jackets 8*a*, 8*b*, 8*c*, are supplemented by the two crossflows in the connectors 9 (see also FIG. 5).

To remove the sand core 7 after the casting of the cylinder head, in the region of the connectors 9, two accesses 10 are provided which are closed after the removal of the sand core 7 so that the connectors 9 are integrated completely in the outer wall.

Figure 4:
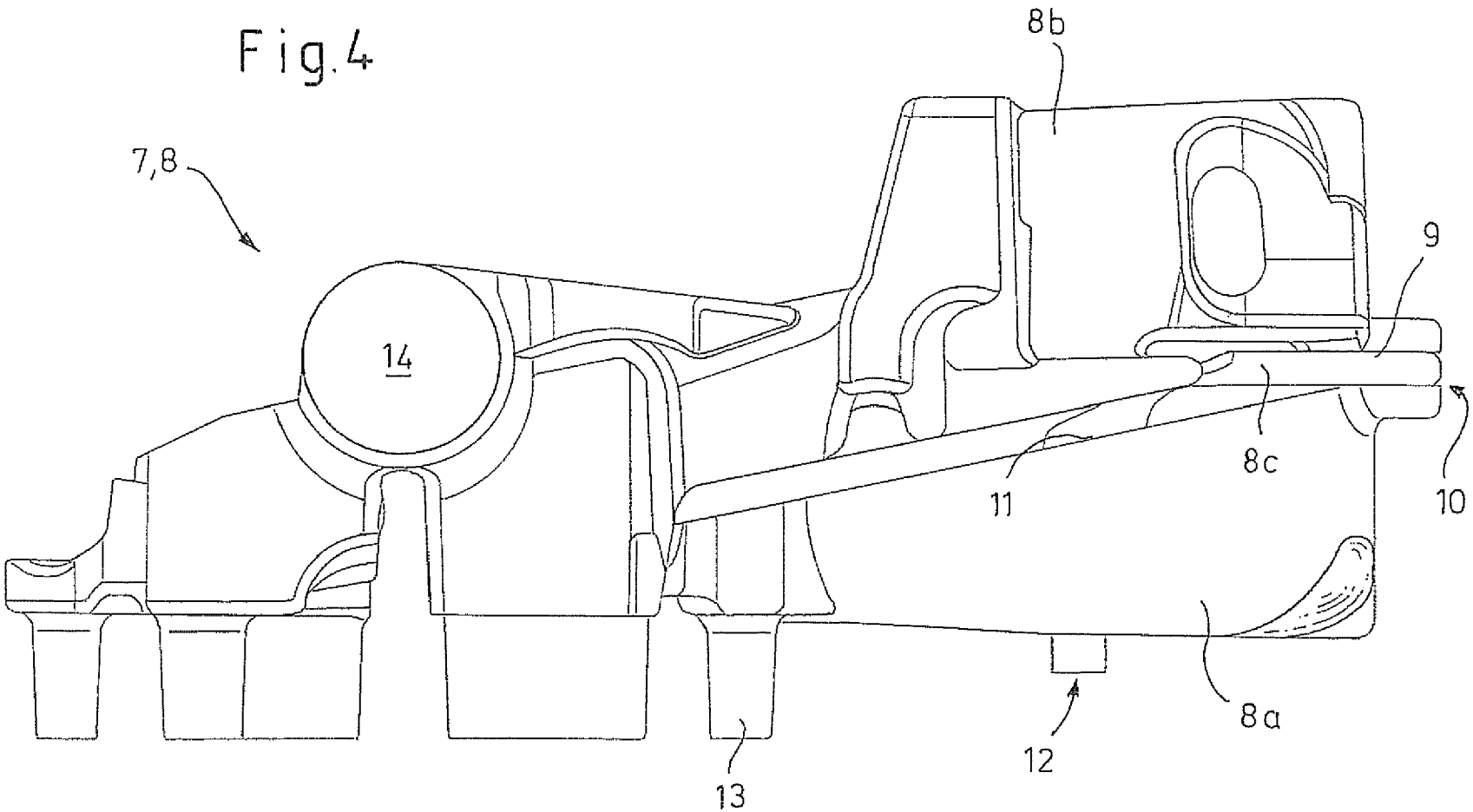
FIG. 4 is a side view of the sand core illustrated in FIG. 3 as viewed in the direction of the longitudinal axis of the cylinder head.

FIG. 4 shows the sand core 7 illustrated in FIG. 3 in a side view looking in the direction of the longitudinal axis of the cylinder head. The same reference symbols as in FIG. 3 are used for the same components, and therefore reference is otherwise made to FIG. 3.

As shown in FIG. 4, an additional connector 11, serving as the passage of coolant, is provided between the lower cooling jacket 8*a* and the upper cooling jacket 8*b*. Moreover, an additional access 12 for removing the sand core 7 and for machining the additional connector 11 is provided, which is closed again in the finished cylinder head. A coolant inlet 13 is used for feeding coolant into the lower cooling jacket 8*a* and a coolant outlet 14 is used for discharging coolant out of the upper cooling jacket 8*b*.

FIG. 5 shows a top view of the parts of the sand core illustrated in FIG. 3, which form the lower and the middle cooling jacket 8*a*, 8*c*, specifically in the direction of the cylinder longitudinal axes. The same reference symbols as in FIG. 3 are used for the same components. The directions of flow of the coolant through the cooling jackets 8*a*, 8*c* are depicted as arrows. The coolant flows in the form of a fan from the coolant inlets of the lower cooling jacket 8*a* into the middle cooling jacket 8*c*, specifically through the two connectors 9 in the outer wall and the additional connector 11.

Figure 6:
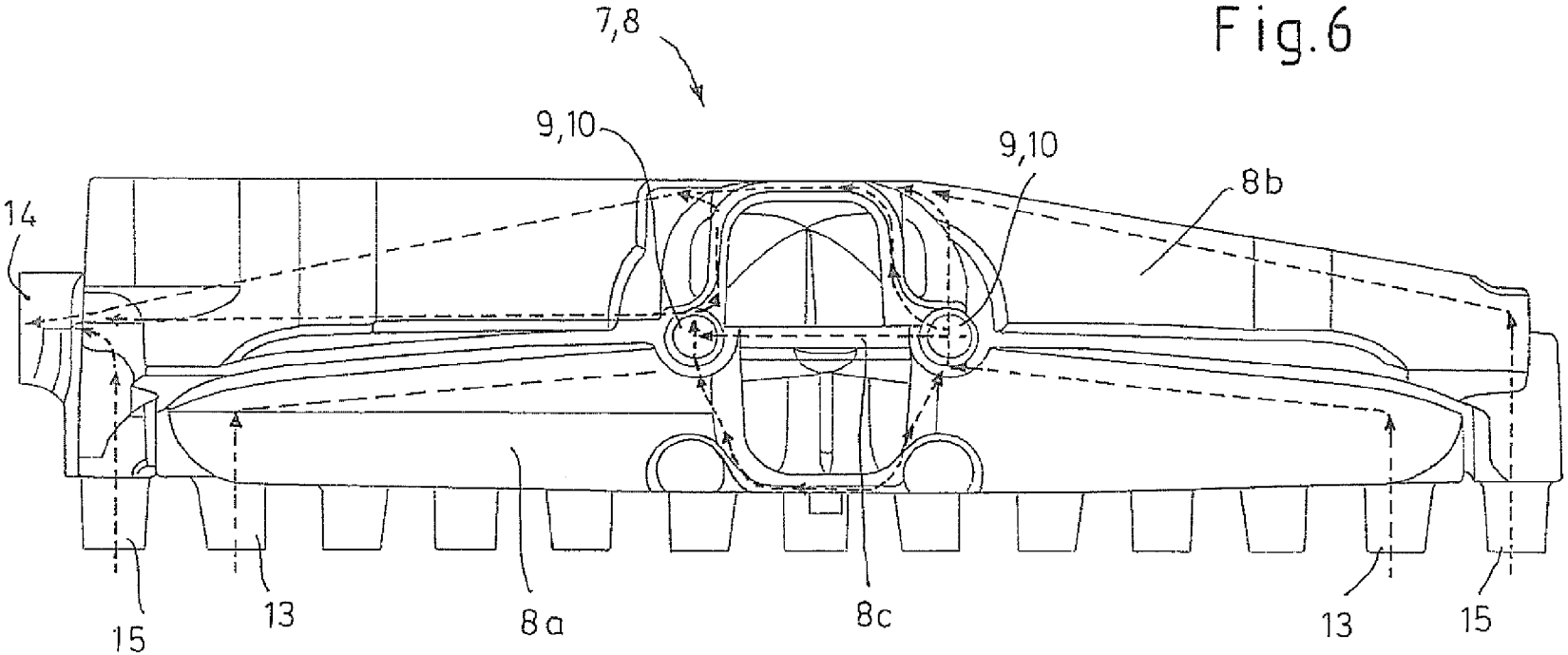
FIG. 6 is a side view of the sand core illustrated in FIG. 3 as viewed perpendicularly with respect to the longitudinal axis of the cylinder head.

FIG. 6 shows the sand core 7 illustrated in FIG. 3 in a side view looking perpendicularly with respect to the longitudinal axis of the cylinder head. The same reference symbols as in FIGS. 3 and 4 are used for the same components.

The coolant flows from the outer coolant inlets 13 of the lower cooling jacket 8*a* along the longitudinal axis of the cylinder head to connectors 9 and vertically through connectors 9 into the middle and lower cooling jackets 8*a*, 8*c*.

The upper cooling jacket 8*b* likewise has two outside coolant inlets 15, the coolant discharged from the cooling jacket 8 via the coolant outlet 14.

Figure 7:
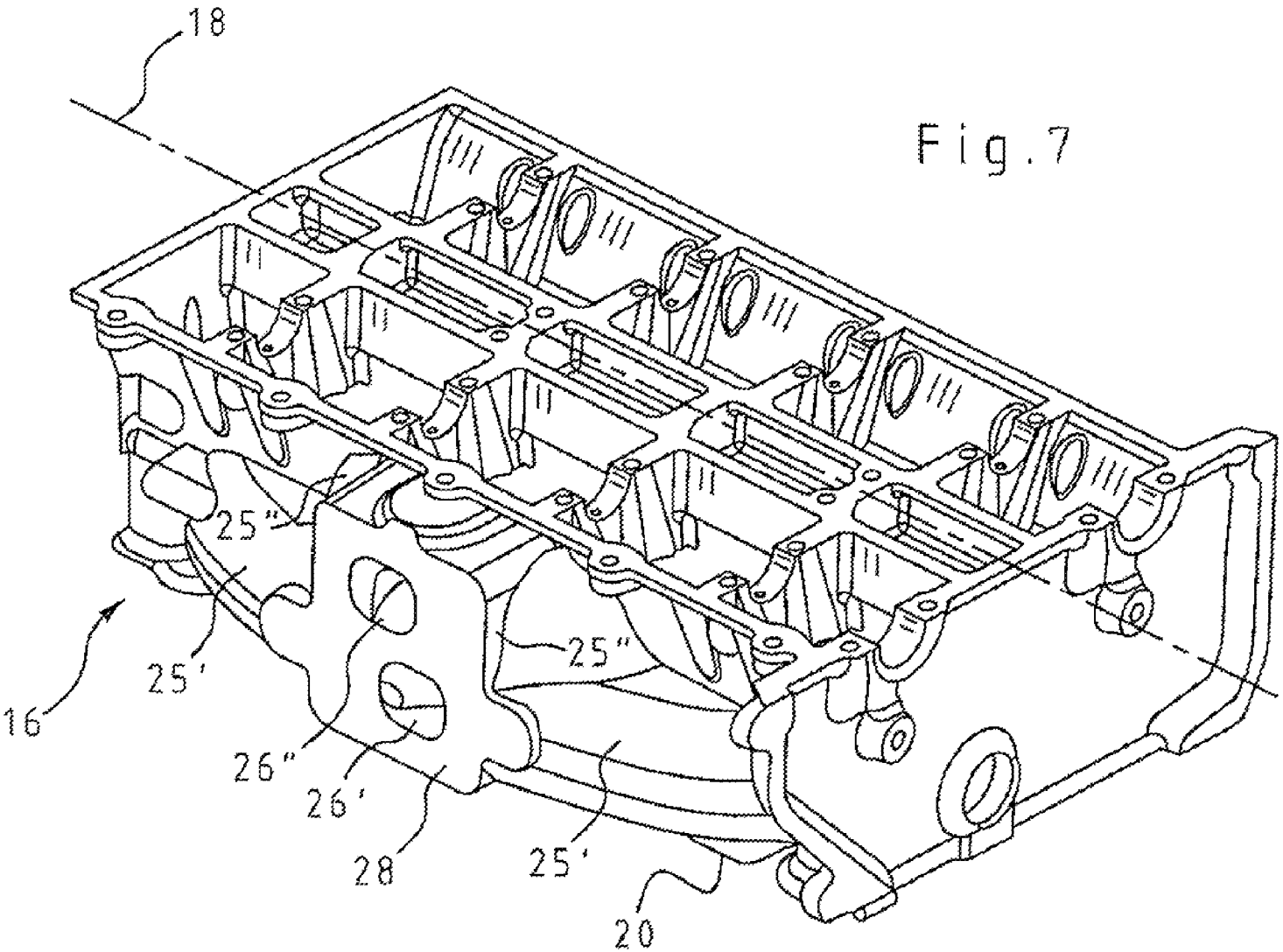
FIG. 7 is a perspective view of the cylinder head according to an embodiment of the disclosure.

A cylinder head 16 is shown in FIG. 7 with the longitudinal axis 18 shown as a dash-dot line. A mounting surface 20 is an underside of cylinder head 16 as viewed in FIG. 7. Mounting surface 20 is proximate the cylinder block when installed. An exterior surface of the exhaust ducts 25', 25" can be seen in FIG. 7. Exhaust ducts 25' carry exhaust gases from outside cylinders and converge to form a combined exhaust duct 26'. Similarly, exhaust ducts 25" carry exhaust gases from outside cylinders and converge to form a combined exhaust duct 26". In the case of an engine with one exhaust port per cylinder, ducts 25', 25" are individual ducts from the single exhaust ports. In the case of an engine with multiple exhaust ports per cylinder, ducts 25', 25" are paired exhaust ducts which are coupled to individual exhaust ducts joining the multiple individual exhaust ducts from one cylinder. Combined exhaust ducts 26' and 26" exit cylinder head 16 at an outer wall 28.

While the best mode has been described in detail, those familiar with the art will recognize various alternative designs and embodiments within the scope of the following claims. For example, cylinders with one or two exhaust ports per cylinder are described. However, the disclosure can be extended to cylinders having more than two exhaust ports per cylinder. Where one or more embodiments have been described as providing advantages or being preferred over other embodiments and/or over prior art in regard to one or more desired characteristics, one of ordinary skill in the art will recognize that compromises may be made among various features to achieve desired system attributes, which may depend on the specific application or implementation. These attributes include, but are not limited to: cost, strength, durability, life cycle cost, marketability, appearance, packaging, size, serviceability, weight, manufacturability, ease of assembly, etc. As an example, for cost reasons, a steering apparatus may be provided on two of the four wheels, in some applications. The embodiments described as being less desirable relative to other embodiments with respect to one or more characteristics are not outside the scope of the disclosure as claimed.

What is claimed is:

1. A cylinder head for a multi-cylinder internal combustion engine, comprising:

a cooling jacket at least partially integrated in the cylinder head;

an exhaust port for each cylinder;

an individual duct adjoining each exhaust port; and an outside combined duct coupled to the individual ducts of outside cylinders wherein the outside combined duct is separated from individual ducts of inside cylinders by the cooling jacket.

2. The cylinder head of claim 1 wherein the cylinder head is adapted to couple to a three-cylinder engine having one inside cylinder.

3. The cylinder head of claim 1 wherein the cylinder head is adapted to couple to a four-cylinder engine having two inside cylinders, the cylinder head further comprising:

an inside combined duct coupled to the individual ducts of inside cylinders wherein the inside combined duct is separated from the outside combined duct by the cooling jacket.

4. The cylinder head of claim 3 wherein the outside combined duct is offset along the longitudinal axis of the cylinder head with respect to the inside combined duct.

5. The cylinder head of claim 3 wherein the cylinder head has a mounting surface which is adapted to be mounted to a cylinder block of the internal combustion engine and the inside combined duct is farther away from the mounting surface than the outside combined duct.

6. The cylinder head of claim 1 wherein the cylinder head has a mounting surface which is adapted to be mounted to a cylinder block of the internal combustion engine and the cooling jacket further comprises:

a lower cooling jacket disposed between the mounting surface and the outside combined duct;

a middle cooling jacket disposed between the outside combined duct and the individual ducts of inside cylinders; and an upper cooling jacket disposed above the individual ducts of inside cylinders on a side away from the outside combined duct.

7. The cylinder head of claim 6, further comprising:

connectors between the lower cooling jacket and the upper cooling jacket adapted to allow coolant to flow between the lower and upper cooling jackets.

8. The cylinder head of claim 1 wherein the cylinder has at least two exhaust ports per cylinder for discharging the exhaust gases out of the cylinder.

9. The cylinder head as claimed in claim 8, further comprising:

a first paired duct coupled between individual ducts coupled to a first of the outside cylinders and the outside combined duct; and a second paired duct coupled between individual ducts coupled to a second of the outside cylinders and the outside combined duct.

* * * * *